US005179789A

United States Patent [19]

Stroud et al.

[11] Patent Number: 5,179,789

[45] Date of Patent: Jan. 19, 1993

[54] KILN WITH AUTOMATIC CONTROL OF HEAT DISTRIBUTION

[75] Inventors: Brian T. Stroud, Richmond; Grant D. Maxwell, Coquitlam; Ronald E. Rohachuk, Richmond, all of Canada

[73] Assignee: The COE Manufacturing Company (Canada), Inc., Vancouver, Canada

[21] Appl. No.: 815,836

[22] Filed: Dec. 30, 1991

Related U.S. Application Data

[63] Continuation of Ser. No. 560,951, Aug. 1, 1990, abandoned.

[51] Int. Cl.[5] ..... F26B 21/00

[52] U.S. Cl. ..... 34/54; 34/224

[58] Field of Search ..... 34/224, 218, 222, 225, 34/227, 54; 432/176, 205, 175, 144, 152

[56] References Cited

U.S. PATENT DOCUMENTS

| | | | |
|---|---|---|---|
| 1,601,966 | 10/1926 | Harris | 34/224 |
| 3,813,214 | 5/1974 | McAlpine | 432/144 |
| 3,830,146 | 8/1974 | Kaiser | 98/110 |
| 3,947,237 | 3/1976 | Leisenberg | 432/144 |
| 3,991,482 | 11/1976 | Brock et al. | 432/144 |
| 4,162,141 | 7/1979 | West | 432/152 |
| 4,168,951 | 9/1979 | Drugge | 432/144 |
| 4,345,510 | 8/1982 | Sterett | 98/110 |
| 4,516,012 | 5/1985 | Smith et al. | 432/176 |
| 4,610,197 | 9/1986 | Van Becelaere | 98/110 |

*Primary Examiner*—Henry A. Bennet

*Attorney, Agent, or Firm*—Townsend and Townsend

[57] ABSTRACT

An improved direct or indirect fired drying kiln having a drying chamber, a burner for heating air, a ducting system in the drying chamber for distributing heated air, a fan for circulating heated air through the ducting system, and venting openings in the ducting system to release heated air to various zones of the drying chamber is provided. The kiln improvement involves providing temperature sensors in the drying chamber in communication with a system for automatically controlling and actuating the venting means in order to control the flow of heated air to each drying chamber zone to achieve any desired temperature distribution throughout the drying chamber. The system can also be operated manually.

9 Claims, 3 Drawing Sheets

Fig. 1.
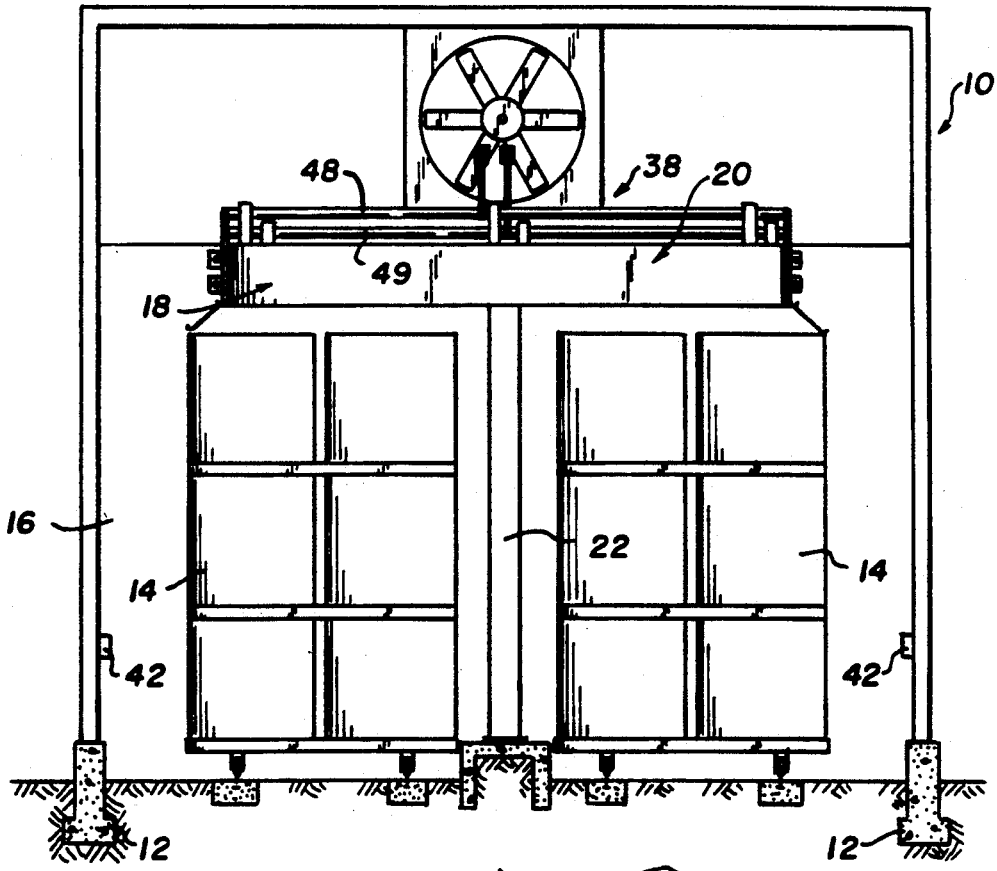
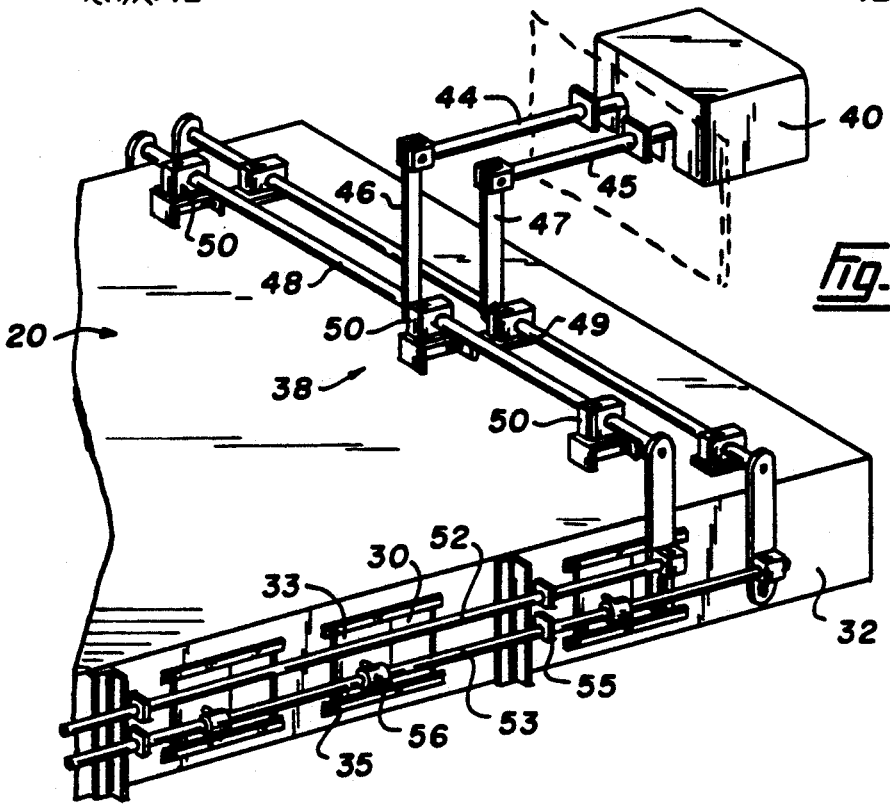
Fig. 2.

KILN WITH AUTOMATIC CONTROL OF HEAT DISTRIBUTION

This is a continuation of application Ser. No. 07/560,951, filed Aug. 1, 1990, now abandoned.

FIELD OF THE INVENTION

This invention relates to a drying kiln having means for controlling the temperature distribution throughout the kiln.

BACKGROUND OF THE INVENTION

Direct or indirect fired drying kilns are used to dry cut lumber. In a direct fired kiln, a fuel such as propane or natural gas is combusted at a burner to directly heat air which is circulated through a plenum or distribution duct which extends along the length of the kiln drying chamber. In an indirect fired kiln, a heat exchanger transfers heat generated by a heat source such as a burner to the air to be circulated through the kiln. The indirect fired kiln avoids circulating combustion products with the heated air. Vents are provided in the plenum through which the circulated heated air escapes to heat the interior of the kiln. These vents divide the drying chamber of the kiln into various zones. Presently, the vent openings through which the circulated air escapes are manually adjusted once at start-up in an attempt to ensure an even heat distribution along the length of the kiln drying chamber. Thereafter, there is no way of adjusting the distribution of heat in the kiln. Additionally, the lumber loaded into the kiln to be dried may be of varying moisture content. The wetter lumber should have hotter air directed to it, in order that it should dry to a moisture content equal to the rest of the lumber. With drier batches of lumber, the reverse is required.

The present invention provides an improved direct or indirect fired kiln in which the distribution of heat along the length of the kiln drying chamber can be automatically controlled to ensure that equal drying of lumber in the kiln is achieved.

SUMMARY OF THE INVENTION

Accordingly, the present invention provides a direct or indirect fired drying kiln having a drying chamber, means for heating air, a ducting system in the drying chamber for distributing heated air, means for circulating heated air through the ducting system, and venting means in the ducting system to release heated air to various zones of the drying chamber and the improvement comprising means for automatically or manually controlling and actuating said venting means in order to control the flow of heated air to each drying chamber zone to achieve any desired temperature distribution throughout the drying chamber.

BRIEF DESCRIPTION OF THE DRAWINGS

Aspects of the present invention are illustrated, merely by way of example in the following drawings, in which:

FIG. 1 is a cross-sectional elevation view showing a direct fired kiln equipped with a first embodiment of the present invention employing a linkage system for opening and closing the venting means of the ducting system;

FIG. 2 is a perspective view showing the linkage means of the first embodiment of FIG. 1;

DESCRIPTION OF THE PREFERRED EMBODIMENTS

Figure 3:
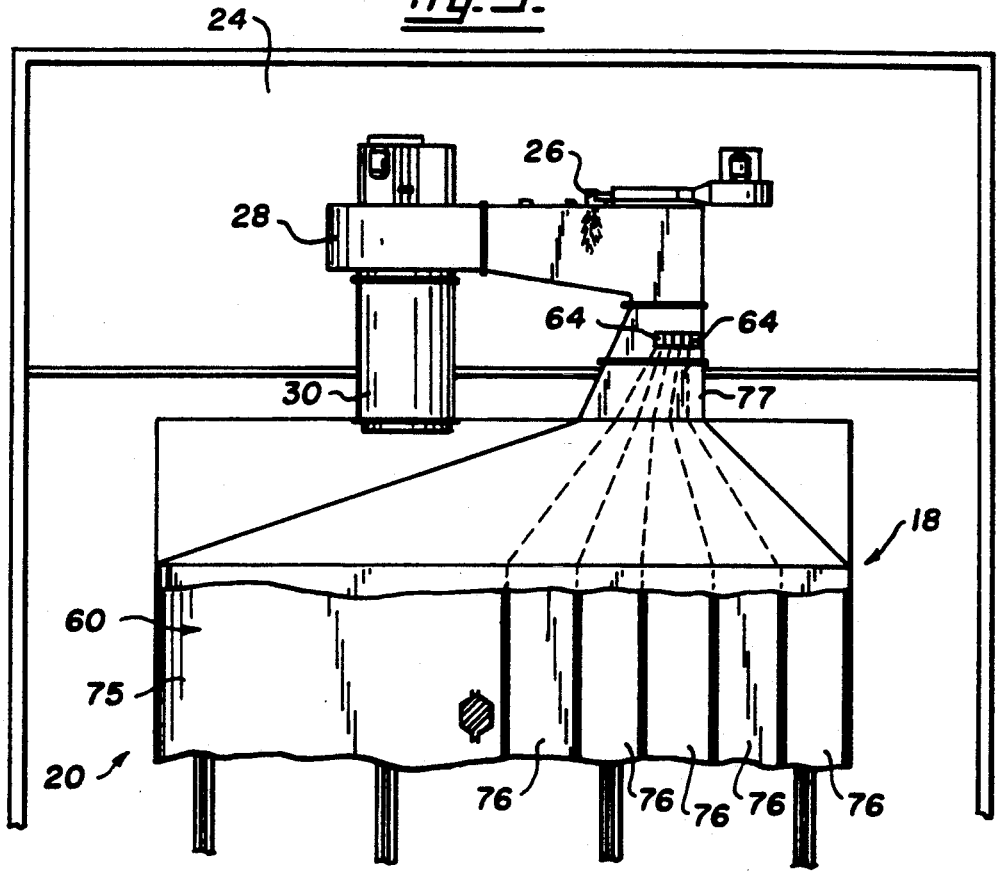
FIG. 3 is a partial plan view showing the air heating and circulating means of a direct fired kiln according to a second embodiment of the present invention.

FIGS. 1 and 3 provide views of a direct fired kiln. Referring to FIG. 1, the kiln comprises an insulated enclosure 10 mounted on conventional concrete footings 12 defining a drying chamber 16. Doors (not shown) are provided in the enclosure walls to allow stacked lumber 14 to be introduced into the interior drying chamber. Above stacked lumber 14, a ducting system 18 is provided to distribute heated air throughout the drying chamber. In the illustrated embodiments of the present invention, ducting system 18 comprises a single rectangular plenum 20. In addition, a series of vertical centre heat tubes 22 may be provided at spaced intervals along the length of the drying chamber and open into plenum 20.

FIG. 3 shows the arrangement whereby air is heated and circulated through the ducting system. At one end of the kiln, there is a chamber 24 housing means for heating air comprising a fuel burner 26 and means for circulating heated air through the ducting system, comprising fan 28. Preferably, burner 26 is fuelled by propane or natural gas. Fan 28 draws air in through intake port 30, directs the air past burner 26 where it is rapidly heated and on through ducting system 18 for distribution throughout drying chamber of the kiln. Venting means are provided along the length of the ducting system to allow for the escape of heated air into the drying chamber.

An indirect fired kiln would employ exactly the same arrangement except that burner 26 and its naked flame would be replaced by a heat exchanger communicating with an appropriate heat source.

The direct fired kiln arrangement just described is entirely conventional. FIGS. 1 and 2 show a conventional direct fired kiln that has been modified according to a first embodiment of the invention which involves fitting the kiln with temperature sensing means within each zone of the drying chamber 16 that communicate with means for controlling and actuating the venting means of the ducting system. In the first embodiment, as best shown in FIG. 2, the venting means comprise a series of openings 30 formed at spaced intervals along the length of the sidewalls 32 of plenum 20. Each opening 30 can be opened and closed to a varying extent by means of a sliding plate 33 that runs in tracks 35 adjacent the edges of the opening. The means for controlling and actuating the venting means comprises a mechanical linking system 38 that extends between a central control unit 40, located at one or both ends of the kiln, and sets of openings 30.

The system of the present invention can be operated manually or automatically. Pairs of openings 30 in opposite sidewalls 32 of plenum 20 divide drying chamber 16 into various heating zones. In the automatic arrangement of the present invention each heating zone is provided with a temperature sensing device 42 that communicates with central control unit 40. Unit 40 contains actuators that are programmed to actuate the linking system to open and close openings 30 in a heating zone via sliding plates 33 depending on the temperature detected and required in the zone.

In FIG. 2, a simplified linkage system is shown in which there are two actuating rods 44 and 45 extending from control unit 40. Rods 44 and 45 are pivotally connected to members 46 and 47, respectively, which in turn are rigidly attached to rotatable shafts 48 and 49, respectively, held in bearing blocks 50. Rotatable shafts 48 and 49 are pivotally connected to longitudinally extending rods 52 and 53, respectively. There are identical pairs of rods found along each sidewall of the plenum. Rods 52 and 53 are constrained to move longitudinally in housing 55 mounted along the length of plenum chamber. In FIG. 2, lower rod 53 is attached by mountings 56 to a number of sliding plates 33.

It is apparent from the illustrated arrangement that when actuating rod 45 is moved backward or forward by control unit 40 in response to temperature information from temperature sensor 42, shaft 49 will be rotated resulting in longitudinal displacement of shaft 53 to vary the degree to which any connected sliding plates 33 cover their respective venting openings 30. By varying the size of venting openings 30 in this manner, the amount of heated air flowing to a zone can be automatically controlled.

In the manual arrangement of the present invention, actuating rod 45 can be adjusted by hand.

In FIG. 2, lower control 53 is shown controlling at least three sliding plates 33 on each side of plenum 20. These three sliding plates with their associated openings and identical set on the opposite side of the plenum 20 define a single heating zone as the plates all move the same distance and direction in response to control unit 40. Upper control rod 52 controls a further set of sliding plates further along the plenum. Obviously, any number of control units and linkage systems can be used to control as many venting openings as necessary to provide for the desired heat distribution throughout the drying chamber.

Figure 5:
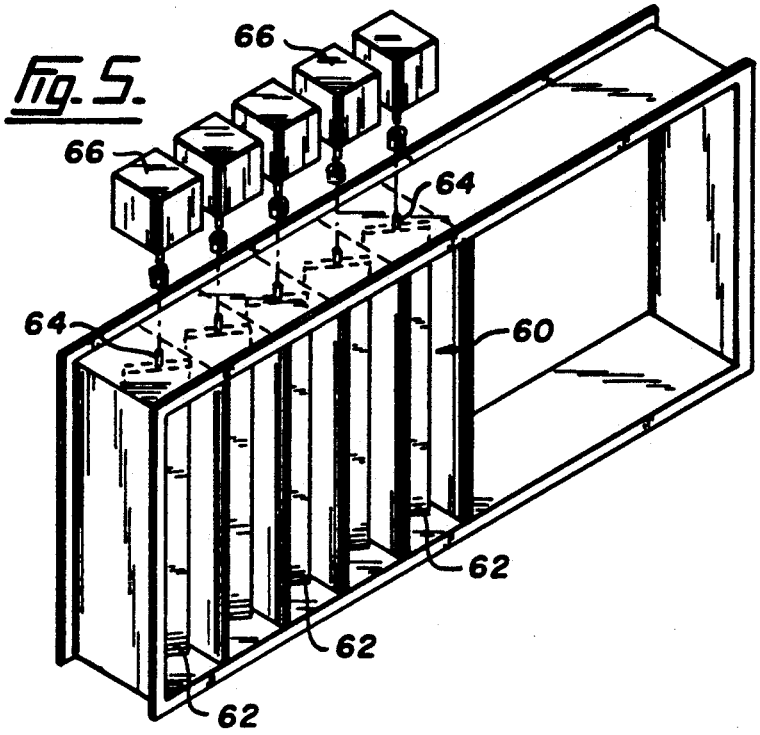
FIG. 5 is a detailed view of the baffle means of the second embodiment.
Figure 4:
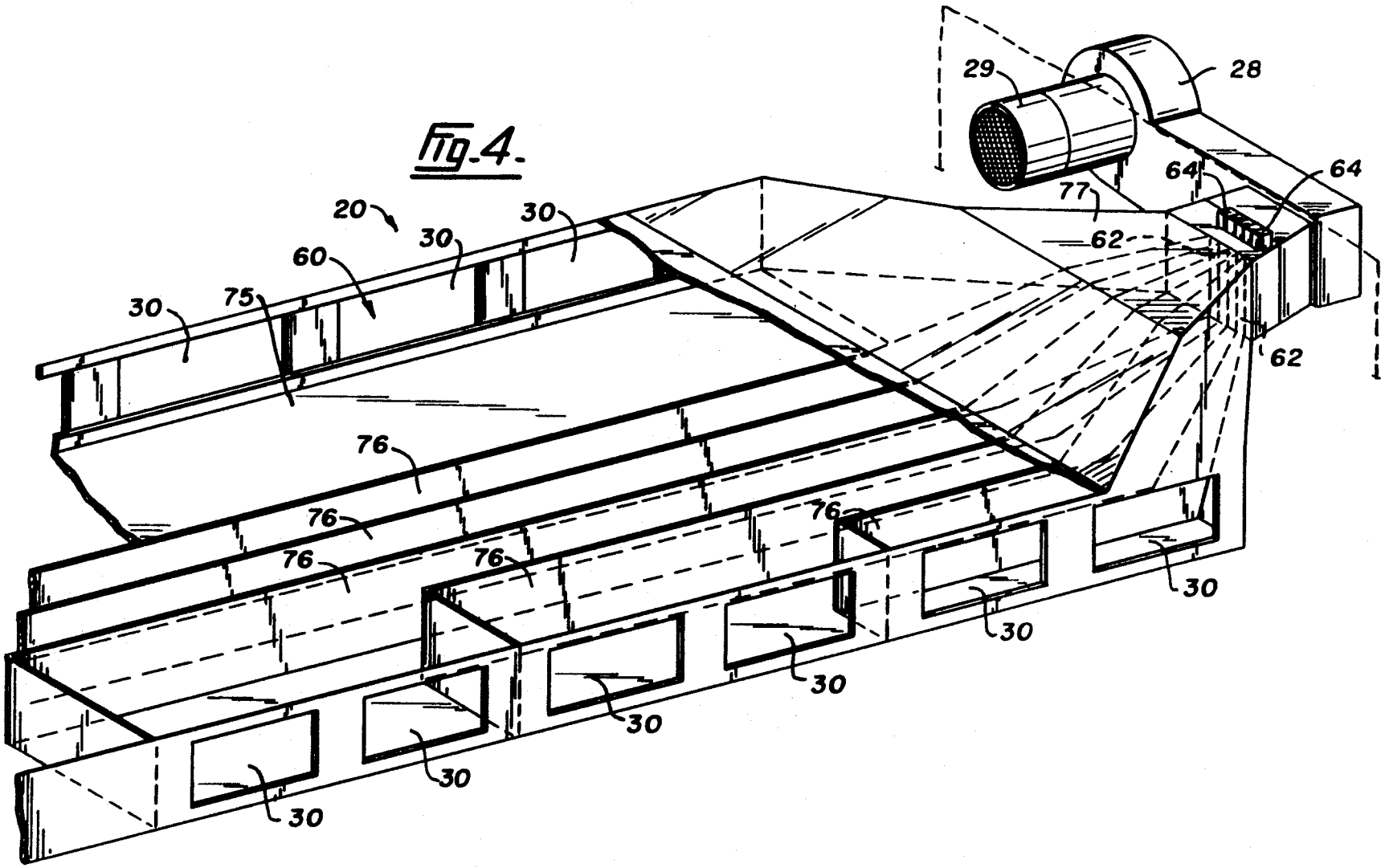
FIG. 4 is a perspective view showing in greater detail the ducting system of the second embodiment.

FIGS. 3, 4 and 5 illustrate a second embodiment of the present invention that can be operated automatically or manually. As best shown in FIG. 4, plenum 20 is divided into a plurality of passages 60 and each passage leads to one or more of openings 30 formed in the sidewalls of the plenum. In this second embodiment, it is not necessary to equip openings 30 with sliding plates 33 as means for automatically controlling and actuating the venting system comprise baffle means positioned in the passages to control the flow of heated air. Each baffle means comprises a longitudinal plate 62 that is mounted on a rotatable shaft 64 extending across the height of a passage 60 as best shown in FIG. 5. Plate 62 is dimensioned such that it can be rotated into the cross-section of the passage to essentially block the passage. A control unit 66 is mounted directly above each baffle plate and has a motor to rotate shaft 64 in order to vary the extent to which a passage 60 is blocked by plate 62. In a similar manner to the arrangement of the first embodiment, each control unit 66 is in communication with a temperature sensor in the zone which the control unit supervises.

In a preferred arrangement best seen in FIG. 3, plenum 20 is divided into a first large passage 75 that occupies substantially half the plenum and communicates with all openings 30 along one side of the plenum. The other half of the plenum is divided into a plurality of smaller second passages 76 that each communicate with one or more openings 30 along said second side of the plenum. FIG. 4 provides a perspective view of this arrangement in which the smaller second passages 76 each communicate with two openings 30.

In order to ensure that baffle plates 64 are of a manageable size plenum 20 communicates with the burner 26 and fan 28 through a transition section of ducting 77. Smaller second passages 76 are each provided with a control unit and baffle plate arrangement while large first passage 75 has no baffle plate and is always available for heated air circulation. In such an arrangement, the temperature profile in the kiln is controlled by adjusting the distribution of heated air through openings 30 at the side of the plenum to which small second passages 76 lead.

In a further embodiment of the present invention, which is a modification of the first embodiment, it is also contemplated that the linkage system can be replaced by a series of control units, one unit associated with each of the openings in the plenum side wall to open and close slide plates 33.

Although the present invention has been described in some detail by way of example for purposes of clarity and understanding, it will be apparent that certain changes and modifications may be practised within the scope of the appended claims.

I claim:

1. In a drying kiln having a drying chamber, means for heating air, a ducting system in the drying chamber for distributing heated air, means for circulating heated air through the ducting system, and venting means in the ducting system to release heated air to the drying chamber, the improvement comprising said ducting system extending substantially the length of said drying chamber and said venting means comprising a plurality of apertures formed along the length of said ducting system to define a plurality of drying zones within said drying chamber, heated air flow control means for controlling the flow of heated air to said apertures, and temperature sensing means in said drying chamber in communication with said heated air flow control means for automatic control thereof to deliver heated air to each drying chamber zone as required to achieve any desired temperature distribution throughout the drying chamber.

2. A kiln as claimed in claim 1, in which said heated air flow control means comprises mechanical linking means extending between a central control unit and each of said apertures, said linking means being actuated by said control unit to vary the size of said apertures in response to readings from said temperature sensing means.

3. A kiln as claimed in claim 1 in which said heated air flow control means comprises a control unit associated with each of said apertures to vary the size of said apertures in response to readings from said temperature sensing means.

4. A kiln as claimed in claim 1 in which said heated air flow control means comprises a plurality of passages formed in said ducting system, each passage leading to one or more of said apertures to define a zone in said drying chamber, baffle means positioned in each of said passages to control the flow of heated air in the passage, and a control unit associated with each of said baffle means in communication with temperature sensing means in the zone.

5. A kiln as claimed in claim 4 in which the ducting system includes a large plenum of essentially rectangular cross-section having first and second sides formed with said venting apertures, said plenum being divided into a first passage that occupies substantially half of the plenum and communicates with all apertures along said first side of the plenum and a plurality of smaller second passages that each communicate with one or more openings along said second side of the plenum.

6. A kiln as claimed in claim 5 in which said smaller second passages are each provided with a baffle means to control heated air flow circulation and said larger first passage is unobstructed.

7. A kiln as claimed in claim 4 in which each of said baffle means comprises a plate rigidly mounted on a rotatable shaft that is controlled by said control unit.

8. A kiln as claimed in claim 1 in which said means for heating air comprises a burner for directly heating the air.

9. A kiln as claimed in claim 1 in which said means for heating air comprises a heat exchanger.

* * * * *